United States Patent [19]

Corrigan et al.

[11] Patent Number: 4,565,290

[45] Date of Patent: Jan. 21, 1986

[54] DISPLAY RACK

[75] Inventors: James L. Corrigan, Lancaster; Gerard M. Schouten, Lititz, both of Pa.

[73] Assignee: Armstrong World Industries, Inc., Lancaster, Pa.

[21] Appl. No.: 609,998

[22] Filed: May 14, 1984

[51] Int. Cl.[4] ..... A47G 19/08

[52] U.S. Cl. ..... 211/41; 40/611; 211/194

[58] Field of Search ..... 211/40, 41, 50, 126, 211/194; 40/611, 618, 10 R; 312/111; 220/23.4

[56] References Cited

U.S. PATENT DOCUMENTS

| | | | |
|---|---|---|---|
| 935,191 | 9/1909 | Day | 40/611 |
| 1,421,022 | 6/1922 | Mollet | 40/611 |
| 1,973,616 | 9/1934 | Fleeman | 40/618 |
| 2,012,385 | 8/1935 | Gearing | 40/611 |
| 2,863,242 | 12/1958 | Britton | 40/618 |
| 3,659,365 | 5/1972 | Eaton | 40/611 X |
| 3,872,614 | 3/1975 | Seitz | 40/611 |

*Primary Examiner*—Ramon S. Britts
*Assistant Examiner*—Sarah A. Lechok Eley

[57] ABSTRACT

The display rack is formed from a number of modules which consist of molded plastic framing units having projecting guide pins which permit the units to be interconnected. The side edge of each unit adjacent the guide pins is open, while the remaining edges of the unit are provided with raised border means. Therefore, tile or literature to be displayed can be slipped into the framing unit and when the modules are attached together, all edges of a display are framed. The unit gives the appearance of a single unit rather than a unit formed form a plurality of modules.

4 Claims, 2 Drawing Figures

DISPLAY RACK

BACKGROUND OF THE INVENTION

1. Field of the Invention

The invention is directed to a display rack and, more particularly, to a display rack that is formed from a series of modules yet gives the appearance of being a simple unitary structure.

2. Description of the Prior Art

U.S. Pat. Nos. 3,659,365; 4,069,941; and 3,872,614 show molded plastic display structures which are formed from interconnected modules.

U.S. Pat. Nos. 2,012,385 and 3,535,807 are display units that have separate display areas which would appear to be surrounded by border structures.

U.S. Pat. Nos. 3,821,538 and 3,874,758 are typical of display racks containing inserts for material.

Finally, U.S. Pat. No. 4,128,955 is typical of a single plastic frame member having a recess to receive material to be displayed.

SUMMARY OF THE INVENTION

The invention is directed to a flat display assembly which is composed of at least a first part which has two recessed areas with each recessed area having three sides formed with a raised border means. A second part is provided to be attached to the first part and formed the fourth raised border means for each recessed area.

A plurality of first part units may be assembled together and the side of the next adjacent first part forms the fourth border edge for the preceding first part and only the last first part used needs to have the second part placed thereon to form the finished fourth border means.

In effect, a series of modules are fastened together to form any number of dual recessed areas for displaying individual floor tile units in one recess and descriptive material about the floor tile unit in the second recess. Depending upon the number of floor tile units to be displayed, the number of first part units corresponds thereto. It is possible that the first part units could be made of a reduced size to provide a reduced size display and to provide a take-up-spacer for adjustment of the overall width of a display.

The modules or parts of the display rack are assembled together and are placed upon a conventional flat display shelf such as is typically used in retail outlets. Alternatively, the display rack could be inclined in position on a typical display shelf so that one edge is resting on a display shelf and the other edge is resting up against the back of the display shelf. Consequently, the display rack of the invention herein is capable of laying almost on a horizontal plane resting on a shelf or resting in position at an approximate 45° angle to the shelf by resting partly on the shelf and partly on the back of a conventional display shelf.

DESCRIPTION OF THE PREFERRED EMBODIMENT

Figure 1:
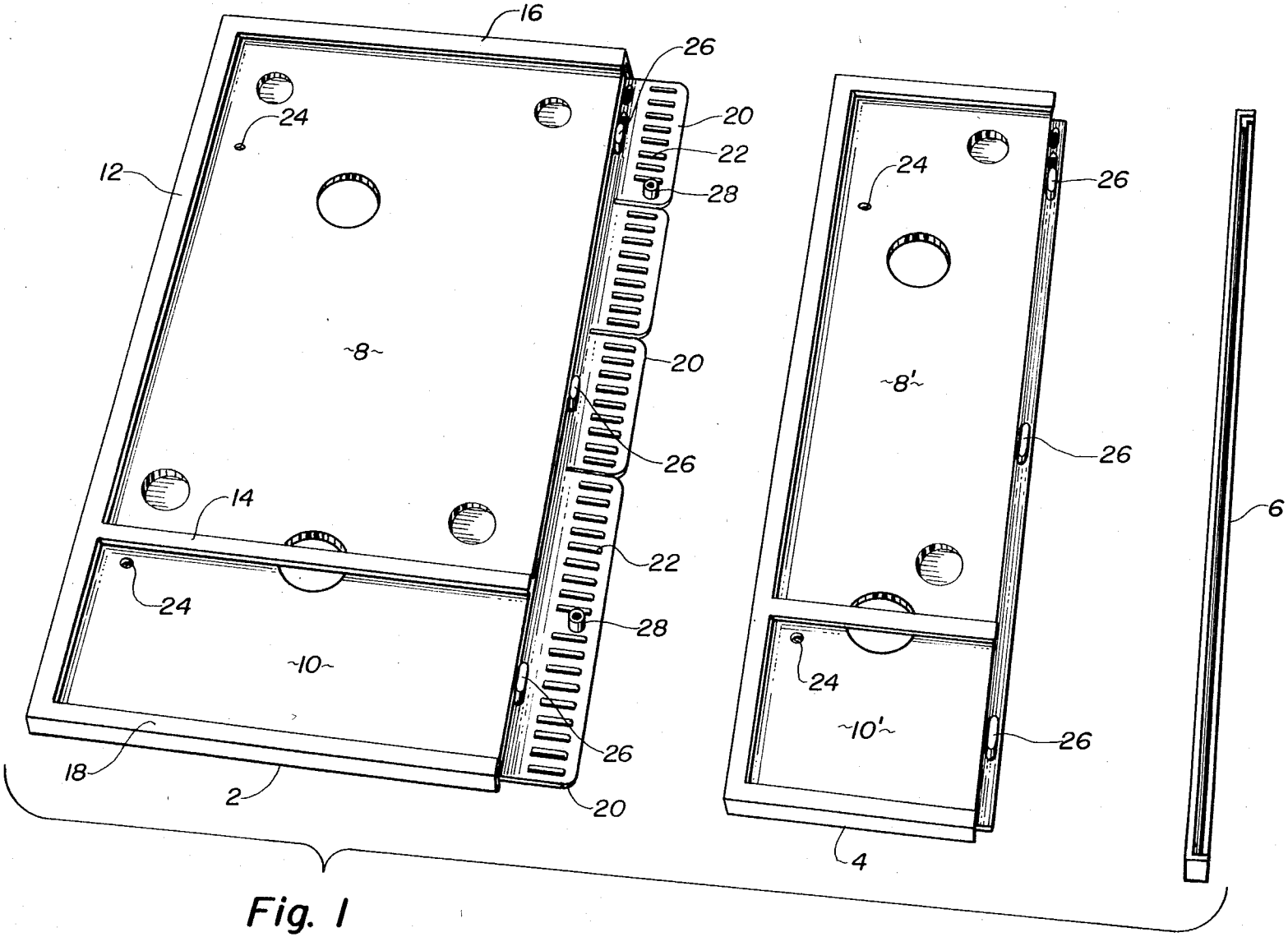
FIG. 1 is a showing of the individual parts of the display rack.

The invention is formed primarily from three modular units which are shown in FIG. 1 and identified as parts 2, 4 and 6. The first part 2 is a self-supporting plastic material which is formed from hi-impact styrene and is molded with the thickness of approximately 60–100 mils so that it may rest upon its lower edge and upper edge in an inclined position and be self-supporting. The first part 2 has two recessed display areas 8 and 10 with each of the display surfaces being surrounded on three sides by a raised border means. Raised border means 12 on the left side of part 2 forms a border for both recessed areas 8 and 10. A raised border means 14 extending between the recessed areas 8 and 10 forms a common raised border between recessed areas 8 and 10. Parallel to raised border means 14 is raised border means 16 and 18 which form the third sides of the recessed areas 8 and 10. There is no raised border means provided on the fourth side of recessed areas 8 and 10, which side will be the right side of part 2. It is noted that part 2 is provided with tabs 20 which have a plurality of slot-shaped apertures 22 therein. When the part 2 is placed against the typical display shelf, the display shelf is a perforated metal unit. The apertures 22 along with the apertures 24 are used as means to receive bolts to mount the first part 2 adjacent a conventional metal display shelf. The next module in line is snapped over the projections 26 which are on the tabs 20. It is noted that there also are provided on the tabs 20 small bosses 28 which will match up with the holes 24 of the next succeeding module so that there will be provided spacers and supports for the bolts passing through the holes 24 into the underlying metal shelfing which is supporting the display rack invention herein. A plurality of first part units 2 could be placed in a side by side relationship with the left edge 12 of a first part 2 being snapped over the projections 26 of an adjacent first part 2 to join together two elements 2. The side 12 of the right most module 2 forms the fourth raised border area for the left most module of a series of two modules assembled together.

The modules are approximately 13 inches wide and it is quite possible on a conventional metal display shelf that you will not be able to easily fix a set sum of first part units 2 on the shelf. Therefore, there is provided a third part unit 4 which is a spacer unit of approximately half the size of first part unit 2. Such a unit would receive only half a display rather than a full display. Recess area 8 is sized to take a conventional 12 inch square floor tile and some type of descriptive material for the tile, carpet tile, ceramic tile, etc., will be placed in the smaller recessed area 10. The recess is about 3/16" deep and will hold the tile below the border means so customers will not be able to handle the tile and break its corners. Naturally, the material will have to be cut in half to be placed in recessed areas 8' and 10' of a third part 4. It is noted that third part 4 has the holes 24 for fastening one side of the unit to the metal shelfing with the holes 24 working in conjunction with the bosses 28 to hold the right side of module 2 in place at the same time the left side of module 4 is held in place. Since third part 4 is only half the width of first part 2, no screws are needed on the right side thereof, and therefore only the projections 26 are provided.

At some point when using either first part 2 or third part 4, there will be a point where the end of a series of display modules is reached and therefore, the fourth raised border area must be provided on the right most unit. This is provided by second part 6 which is shown turned upside down in FIG. 1 so that one can see the groove in the underneath thereof. The projections 26 of either first part 2 or third part 4 project into this groove and hold a second part 6 in position on the right side of either display module. Border means 12 has a groove such like part 4.

Figure 2:
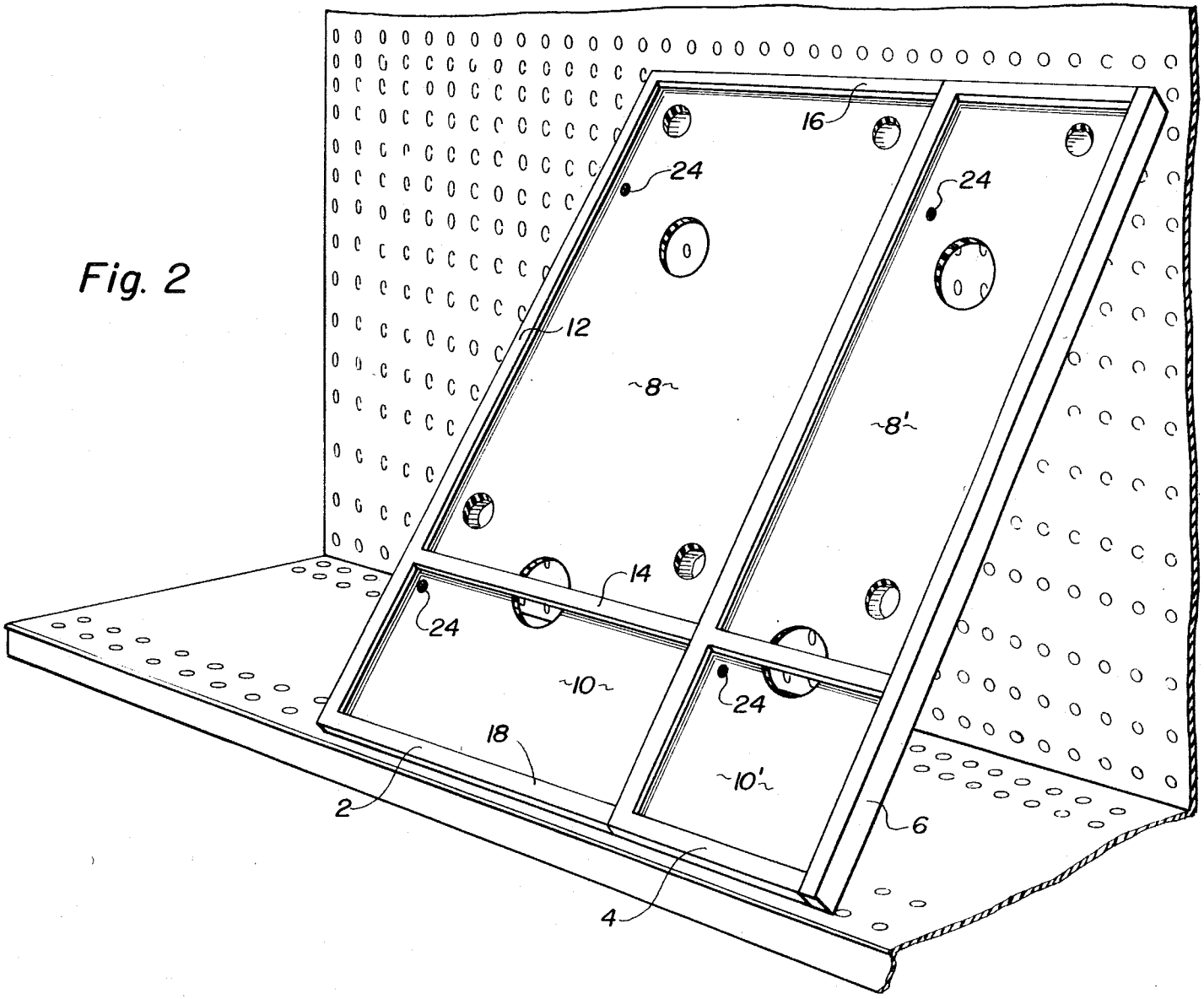
FIG. 2 is an assembled view of the display rack showing it mounted in an inclined position on a typical display shelf.

As shown in FIG. 2 there is assembled together the three units forming an inclined display which is resting on a metal display shelf at its lower edge and at its upper edge, the back of the metal display shelf and held in place by small flexible right angle plastic brackets. This is the typical peg board type of display used in most retail stores. It is possible that the display modules could be placed directly upon the horizontal shelf and fastened thereto, rather than inclined at the approximate 45° to the metal shelf as shown in FIG. 2 of the drawing.

There is therefore shown a flat display assembly which is composed of a first part 2 having two recessed display surfaces 8 and 10 and a second part 6. All the parts are made of a self-supporting plastic material so that they can support themselves when they are resting on their upper and lower edges. The first recessed area 8 is large enough to hold a sample floor tile and the other recess area 10 is substantially smaller and will hold descriptive material on the floor tile. The part 2 and the smaller version thereof, third part 4, are all formed with raised border means on three sides of each of the recessed area. The raised border means for recessed area 8 are elements 12, 14 and 16 and the raised border areas for recessed area 10 are 12, 14 and 18 and these raised border means form the sides for the recessed area. A second part 6 is used to form the fourth raised border means and it must be placed on the right side of either of the parts 2 and 4. The second part 6 provides the fourth border means so that both recessed areas 8 and 10 have raised sides completely thereabout.

A third part 4 is provided and this part is similar to the first part 2 in construction, except it is approximately one-half the width of said first part and will only hold one-half of a sample floor tile. It functions as a spacer unit where full size modules will be too large for an area where goods are being displayed. It is noted that the parts all have means in the form of projections 26 which will engage recesses in either the second part 6 or below the border means 12 to fasten together the different parts and provide them with an engagement of the parts while at the same time blending together the parts so that they appear to be one composite unit.

As shown in FIG. 2, the display assembly may have the different parts placed in a side by side relationship and the parts may be placed on a conventional store display shelf by either resting flat on the metal shelf or being positioned with their bottom edges on the shelf and their top edges resting against the back to the conventional store display shelf structure.

What is claimed is:

1. A flat display assembly comprising:

(a) a first part having at least two recessed display surfaces with each surface having three raised border means, (b) a second part forming the fourth raised border means for each recessed display surface, (c) said first and second part being made of a self-supporting material, (d) said first part having two recessed areas, one area being large enough to hold a sample floor tile and the other area being substantially smaller to hold descriptive material on the floor tile, (e) said first part having a raised border means on three sides thereof, and a raised border means extending across said first part parallel to the two raised border means, said last mentioned raised border means defining said two recessed areas, each having three raised sides formed by said raised border means, (f) said first part, having a fourth side thereof that does not have a raised border means, having a tab means extending along the entire length of said fourth side and said tab means having there along means for receiving and holding said fourth raised border means in position, and (g) said second part being a strip affixed to the tab means of the first part to form the fourth raised border means so that both recessed areas have raised sides completely thereabout.

2. The display assembly of claim 1 wherein:

(a) the means for receiving and holding said fourth raised border means are projections on said tab means, and (b) said projections engage grooves on the underneath of said fourth raised border means to hold said border means in position.

3. The display assembly of claim 1 wherein:

(a) a third part is provided and this third part is similar to said first part in construction except it is one-half the width of said first part and will hold only one-half a sample floor tile, (b) said first part having said third part placed adjacent its side without the raised border so that the one side of the third part forms the fourth raised border means for each recessed display surface of said first part, and (c) said second part forming a fourth raised border means for each reduced size recessed display surface of said third part.

4. The display assembly of claim 1 wherein:

(a) a plurality of first part units are placed in a side-by-side relationship, (b) a second part is positioned adjacent the right most first part, and (c) said assembled first parts and said second part are placed on a conventional store display shelf.

* * * * *